US009821190B2

(12) United States Patent
Tsai

(10) Patent No.: US 9,821,190 B2
(45) Date of Patent: Nov. 21, 2017

(54) EXERCISE MAT WITH A CONTINUOUS ONE-PIECE ANTI-SLIP STRIP

(71) Applicant: GROUNDING INC., Tortola (VG)

(72) Inventor: Victor Tsai, Taipei (TW)

(73) Assignee: Grounding Inc., Tortola (VG)

( * ) Notice: Subject to any disclaimer, the term of this patent is extended or adjusted under 35 U.S.C. 154(b) by 0 days.

(21) Appl. No.: 15/185,455

(22) Filed: Jun. 17, 2016

(65) Prior Publication Data

US 2017/0304672 A1 Oct. 26, 2017

(30) Foreign Application Priority Data

Apr. 21, 2016 (TW) ..... 105112411 A

(51) Int. Cl.
*A63B 6/00* (2006.01)
*A63B 21/00* (2006.01)
*G01K 11/12* (2006.01)

(52) U.S. Cl.
CPC ..... *A63B 21/4037* (2015.10); *G01K 11/12* (2013.01)

(58) Field of Classification Search
CPC ..... A63B 21/4037; A63B 6/00
USPC ..... 5/417–420
See application file for complete search history.

(56) References Cited

U.S. PATENT DOCUMENTS

2005/0003173 A1 1/2005 Nichols
2011/0035878 A1* 2/2011 Rouse ..... A47G 27/0237 5/417
2011/0072581 A1* 3/2011 Villa ..... A63B 21/4037 5/420
2012/0240336 A1* 9/2012 Dandapure ..... A63B 6/00 5/417

FOREIGN PATENT DOCUMENTS

TW 201442676 A 11/2014

* cited by examiner

*Primary Examiner* — Fredrick Conley
(74) *Attorney, Agent, or Firm* — Muncy, Geissler, Olds & Lowe, P.C.

(57) ABSTRACT

An exercise mat includes a fabric layer defining opposing first surface and second surface, an anti-slip strip of a predetermined width and in a predetermined pattern covered over a part of the first surface of the fabric layer so that the first surface of the fabric layer defines one or multiple exposed portions beyond the anti-slip strip, and an elastic cushion layer covered over the second surface of the fabric layer. The anti-slip strip is a continuous one-piece member defining two opposite lateral portions and a middle portion at different elevations. The fabric layer defines a plurality of local areas in the first surface. At least one exposed portion and a part of the anti-slip strip exist in each local area within a surface area approximately equal to the surface area of the palm of an adult.

16 Claims, 8 Drawing Sheets

EXERCISE MAT WITH A CONTINUOUS ONE-PIECE ANTI-SLIP STRIP

BACKGROUND OF THE INVENTION

1. Field of the Invention

The present invention relates to sports gear technology and more particularly, to an exercise mat with a continuous one-piece anti-slip strip.

2. Description of the Related Art

A conventional double-sided anti-slip exercise mat, as disclosed in Taiwan Patent No. 201442676, is characterized in that an anti-slip layer is provided at each of two opposite surfaces of a fabric layer for enabling each of the two opposite surfaces to be partially exposed to the outside. By means of the functioning of the anti-slip layer and the partially exposed design of the fabric layer, the exercise mat provides anti-slip effects regardless of whether the user's skin has sweat (nonslip in wet and dry environmental conditions). We know that when the skin (for example palm surface) of the user gets sweaty, the fabric surface can provide an anti-slip effect, however, the anti-slip layer will become slippery. When the skin of the user is dry, the fabric surface will become slippery, but the anti-slip layer can effectively achieve the expected anti-slip effects. Therefore, the aforementioned conventional technique can achieve an anti-slip effect in wet and dry environmental conditions.

Further, US 2005/0003173 discloses another design of exercise mat, which achieves an anti-slip effect in wet and dry environmental conditions by providing one or both of two opposite surfaces of a fabric layer with a plurality of discrete anti-slip blocks. However, this design can make the user feel that the surface is not flat, causing uncomfortability. Further, because the anti-slip blocks are separated from one another, a higher proportion of the fabric layer is exposed to the outside, the anti-slip effect of the exercise mat is not good when the skin of the user is dry.

Further, when the aforesaid two prior art exercise mats are in use, it is necessary to put an elastic pad at the bottom side so that when the user presses the body, hands or feet on the anti-slip blocks, the elastic pad can be curved inwards to compensate the protruding height of the anti-slip blocks, making the user to feel that the surface is flat. If the user directly puts the exercise mat on a hard supporting surface or hard floor surface without putting an elastic pad beneath the exercise mat, the user will feel a sense of discomfort.

SUMMARY OF THE INVENTION

The present invention has been accomplished under the circumstances in view. It is the main object of the present invention to provide an exercise mat with a continuous one-piece anti-slip strip, which enables the user to feel a sense of comfort.

It is another object of the present invention to provide an exercise mat with a continuous one-piece anti-slip strip, which has the anti-slip strip configured to provide an uneven surface so as to increase the surface area and to provide a three-dimensional structure, thereby enhancing the anti-slip performance.

To achieve these and other objects of the present invention, an exercise mat with a continuous one-piece anti-slip strip comprises: a fabric layer defining a first surface and an opposing second surface, an anti-slip strip of a predetermined width and in a predetermined pattern and covered over a part of the first surface of the fabric layer so that the first surface of the fabric layer defines at least one exposed portion beyond the anti-slip strip, and an elastic cushion layer covered over the second surface of the fabric layer. The anti-slip strip is a continuous one-piece member, defining two opposite lateral portions and a middle portion between the two opposite lateral portions. In one embodiment, the two opposite lateral portions are relatively lower and the middle portion is relatively higher. In another embodiment, the two opposite lateral portions are relatively higher and the middle portion is relatively lower. The fabric layer defines a plurality of local areas in the first surface. Further, at least one exposed portion and a part of the anti-slip strip exist in each local area within a surface area approximately equal to the surface area of the palm of an adult.

Thus, subject to the design and arrangement of the continuous one-piece design of the anti-slip strip, the exercise mat delivers a comfortable sense of touch. Further, the anti-slip strip has an uneven surface so that the total surface area of the anti-slip strip can be relatively increased to provide a three-dimensional structure and to further enhance the anti-slip performance.

Other advantages and features of the present invention will be fully understood by reference to the following specification in conjunction with the accompanying drawings, in which like reference signs denote like components of structure.

DETAILED DESCRIPTION OF THE INVENTION

Figure 1:
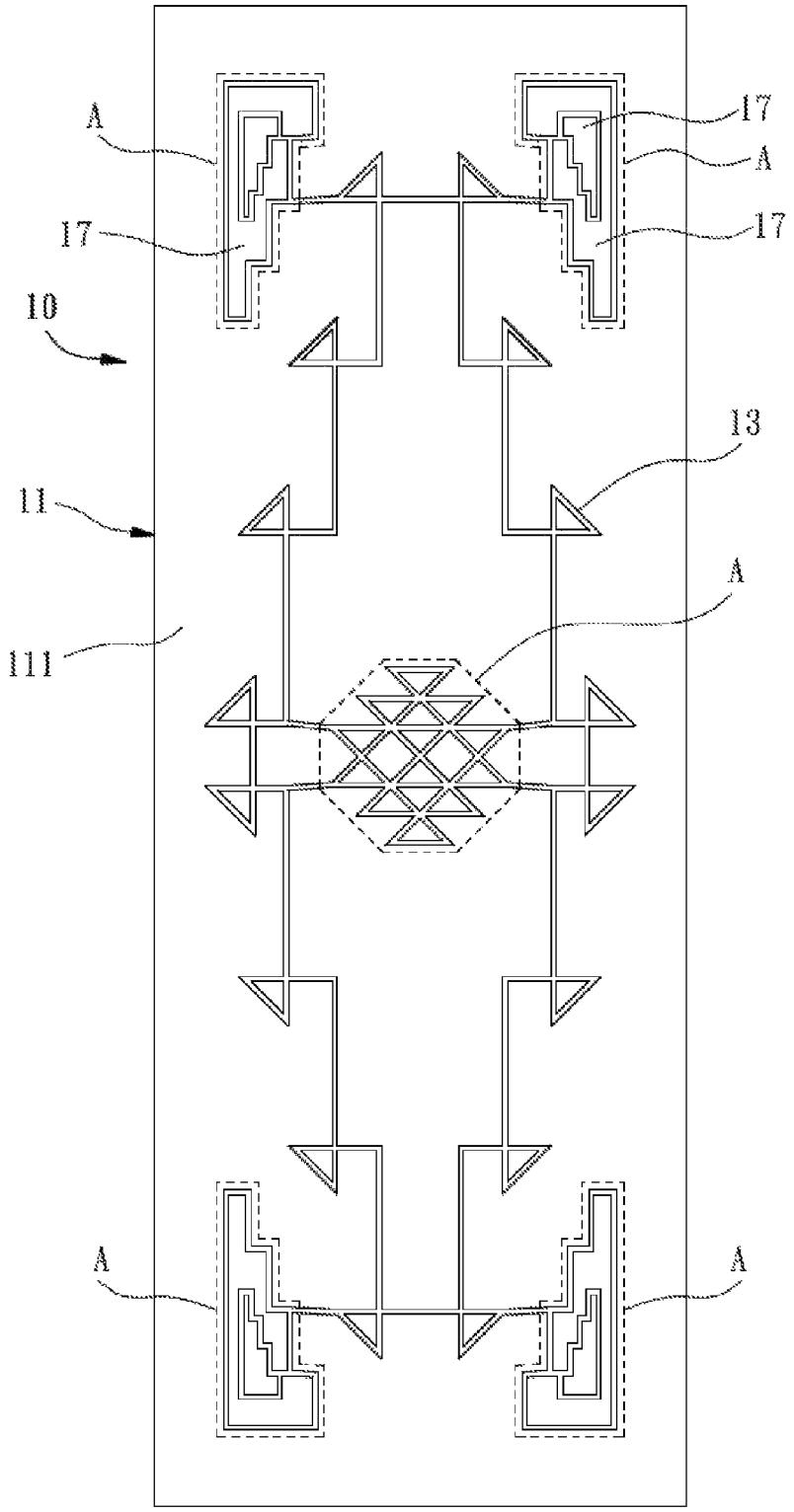
FIG. 1 is a top view of an exercise mat in accordance with a first embodiment of the present invention.
Figure 2:
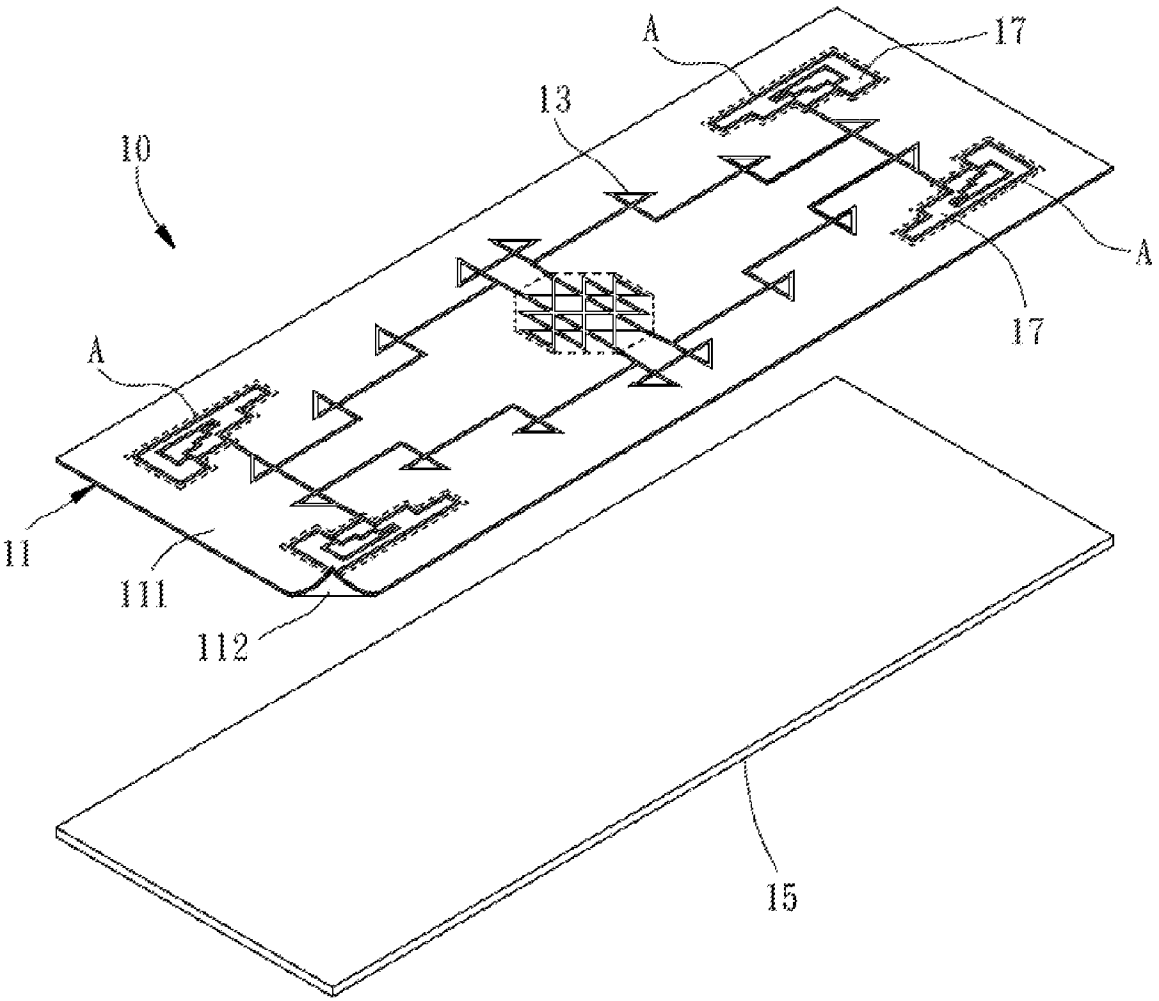
FIG. 2 is an exploded view of the exercise mat in accordance with the first embodiment of the present invention.
Figure 3:
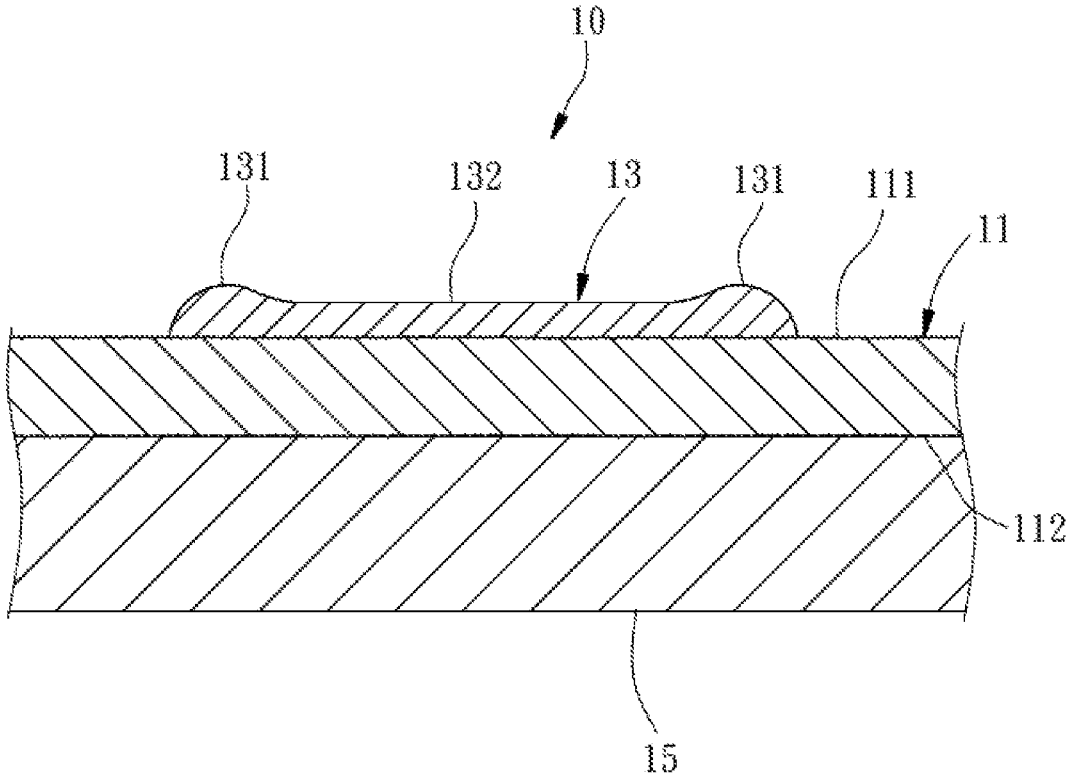
FIG. 3 is a sectional view of a part of the first embodiment of the present invention, illustrating the cross-section of the anti-slip strip.

Referring to FIGS. 1-3, an exercise mat 10 in accordance with the present invention is shown. The exercise mat 10 comprises a fabric layer 11, an anti-slip strip 13 and elastic cushion layer 15.

The fabric layer 11 defines a first surface 111 and an opposing second surface 112.

The anti-slip strip 13 has a predetermined width and exhibits a predetermined pattern, and is bonded to the first surface 111 of the fabric layer 11. The anti-slip strip 13 does not cover the overall first surface 111 of the fabric layer 11 so that the first surface 111 of the fabric layer 11 has a part uncovered and exposed to the outside, i.e., the first surface 111 comprises at least one exposed portion 17. In this embodiment, the material of the anti-slip strip 13 is silicone.

The elastic cushion layer 15 is mounted on and covered over the second surface 112 of the fabric layer 11 to provide flexibility and cushioning effects. The material of the elastic cushion layer 15 can be thermosetting plastics or thermoplastics. In the selection of thermosetting plastics, polyurethane, epoxy resins, unsaturated polyesters or bakelite is preferred. In the selection of thermoplastics, a composite material can be used. The composite material can be prepared by mixing a soft-segment plastic material with a hard-segment plastic material. The soft-segment plastic material can be selected from the group of natural rubber, ethylene-propylene rubber, butyl rubber, polybutadiene, polyisoprene, polyisobutylene and polyethylene-butene. The hard-segment plastic material can be selected from the group of polyethylene, polystyrene, polypropylene, polyurethane, polyester and polyamide.

The anti-slip strip 13 is a one piece member, having the surface thereof configured to provide two relatively higher opposite lateral sides and a relatively lower middle part. Alternatively, the anti-slip strip 13 can be configured to provide a relatively higher middle part and two relatively lower opposite lateral sides. In this embodiment, the anti-slip strip 13 comprises two relatively higher portions 131 located at two opposite lateral sides and a relatively lower middle portion 132 disposed between the two relatively higher portions 131. In this embodiment, the thickness of the relatively lower middle portion 132, of the anti-slip strip 13 is not greater than 1 mm. If the relatively lower middle portion 132 is too thick, it will make the user feel a projected thickness. On the contrary, if the relatively lower middle portion 132 is too thin, it may have insufficient structural strength. So, the relatively lower middle portion 132 should have an appropriate thickness. Most preferably, the thickness of the relatively lower middle portion 132 of the anti-slip strip 13 is about 0.2-0.3 mm. In this thickness, the anti-slip strip 13 will not make the user feel awkward. Further, in the present first embodiment, the anti-slip strip 13 is self intersected, providing a plurality of intersections. So, due to self intersection, the anti-slip strip 13 has multiple exposed portions 17. Further, in this first embodiment, except the intersected locations, the width of the anti-slip strip 13 is consistent in all parts.

Further, the first surface 111 of the fabric layer 11 defines a plurality of local areas A. Further, at least one exposed portion 17 and a part of the anti-slip strip 13 exist in each local area A within a surface area approximately equal to the surface area of the palm of an adult.

The main structure of the first embodiment of the present invention has been described above, the application of this first embodiment is explained hereinafter.

Figure 4:
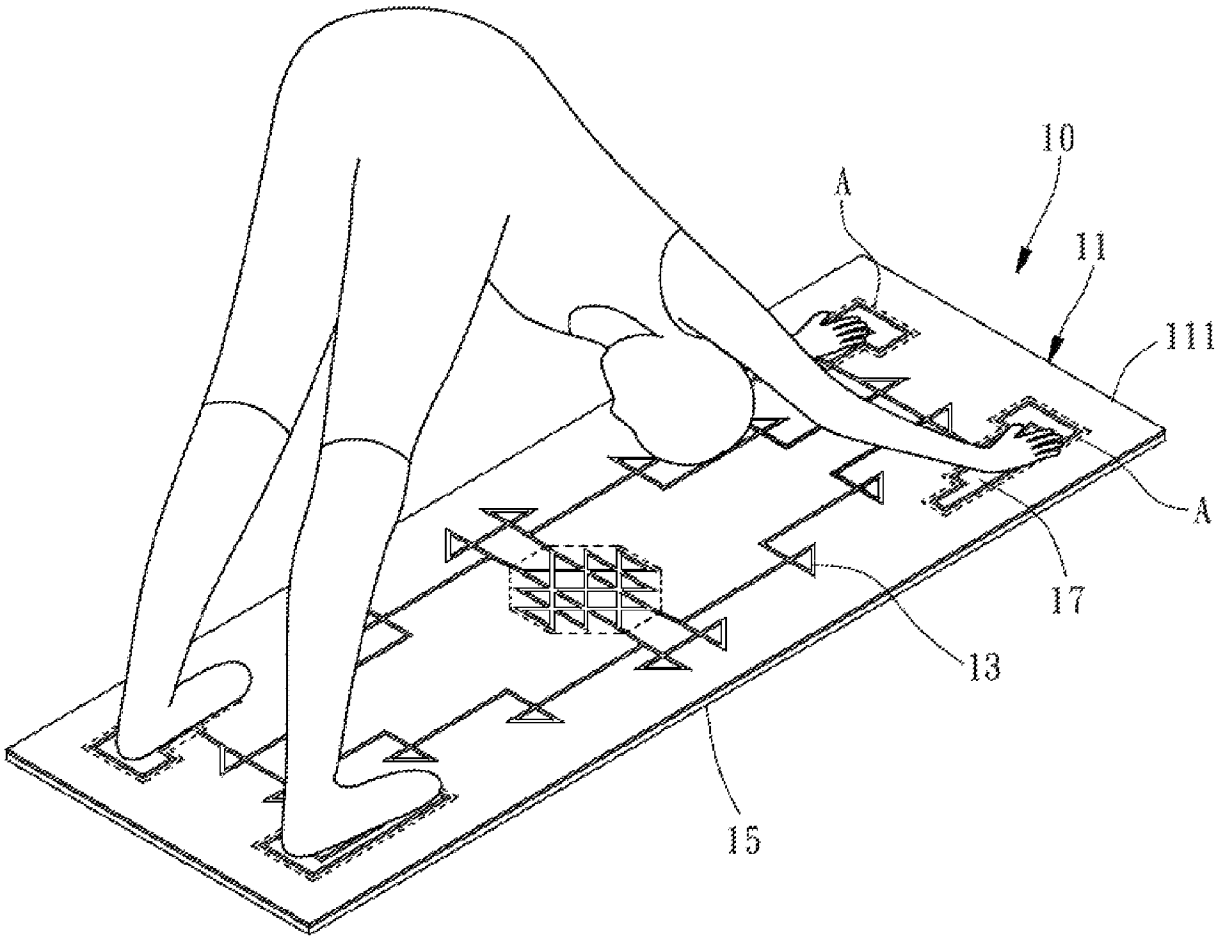
FIG. 4 is a schematic drawing illustrating a status of use of the exercise mat in accordance with the first embodiment of the present invention.

Referring to FIG. 4 and FIGS. 1-3 again, in application, put the exercise mat 10 on the floor with the elastic cushion layer 15 facing downward and kept in contact with the floor. At this time, the user can perform exercises, for example, Yoga exercises on the exercise mat 10. When exercising, the user will frequently press the palms of the user's hands or the soles of the user's feet on the first surface 111 of the fabric layer 11. Because the local areas A are located at the regions the palms of the user's hands or the soles of the user's feet will touch, and, at least one exposed portion 17 and a part of the anti-slip strip 13 exist in each local area A within a surface area approximately equal to the surface area of the palm of an adult, subject to the arrangement of the anti-slip strip 13, the exercise mat 10 provides anti-slip effects regardless of whether the user's skin has sweat (nonslip in wet and dry environmental conditions, and thus, the user can perform exercises on the exercise mat 10 at ease without worrying about sliding of the palms or soles.

Further, subject to the design of the relatively higher portion 131 and relatively lower middle portion 132 of the anti-slip strip 13, the invention increases the surface area of the anti-slip strip 13 for the contact of the user's body skin, providing a three-dimensional structure to enhance the anti-slip performance. Further, subject to the elastic effect of the elastic cushion layer 15, the anti-slip strip 13 will be forced to curve inwardly toward the inside of the elastic cushion layer 15 when it is pressed by the user, making the user to feel that the surface is flat and enabling the user to feel a sense of comfort.

Since the anti-slip strip 13 is a continuous one piece member, the user will not feel any sense of discomfort due to pressing on an uneven surface, and therefore, the invention provides a more comfortable sense of touch over the prior art designs.

Figure 5:
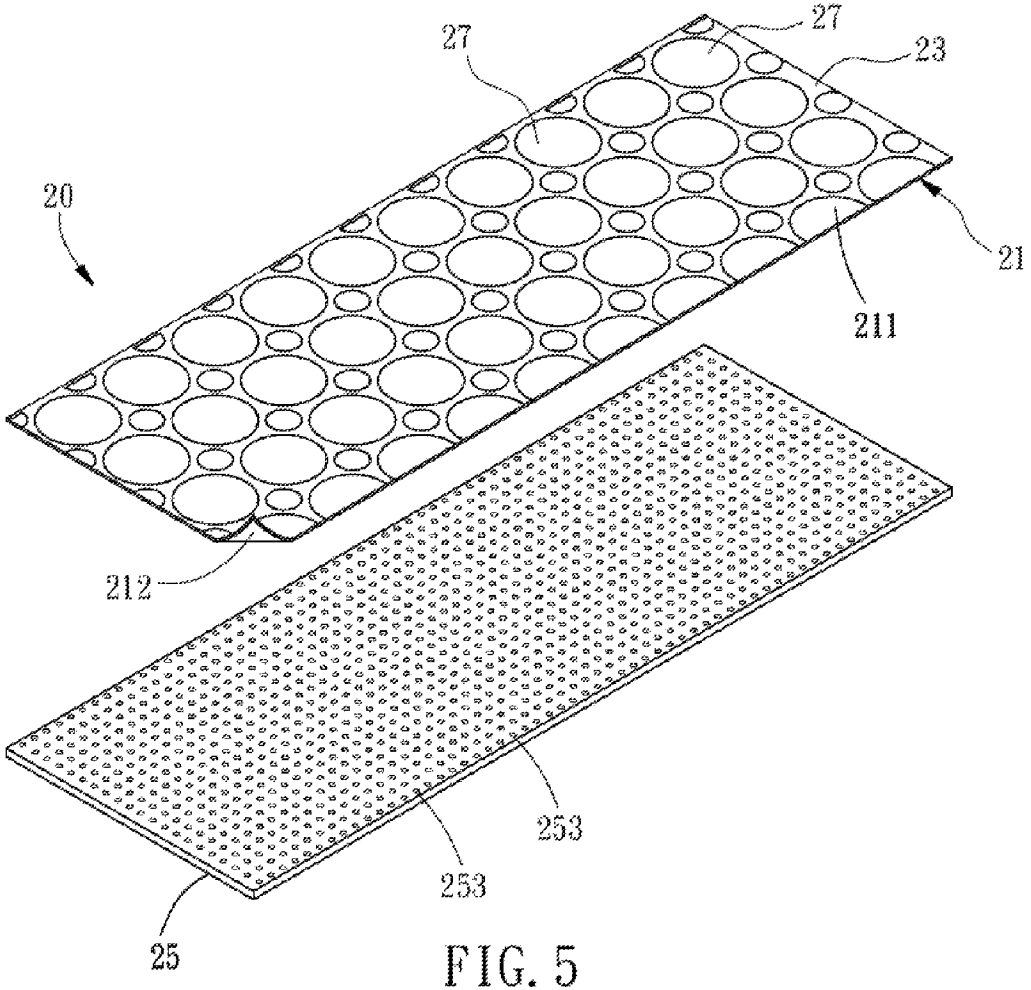
FIG. 5 is an exploded view of an exercise mat in accordance with a second embodiment of the present invention.
Figure 6:
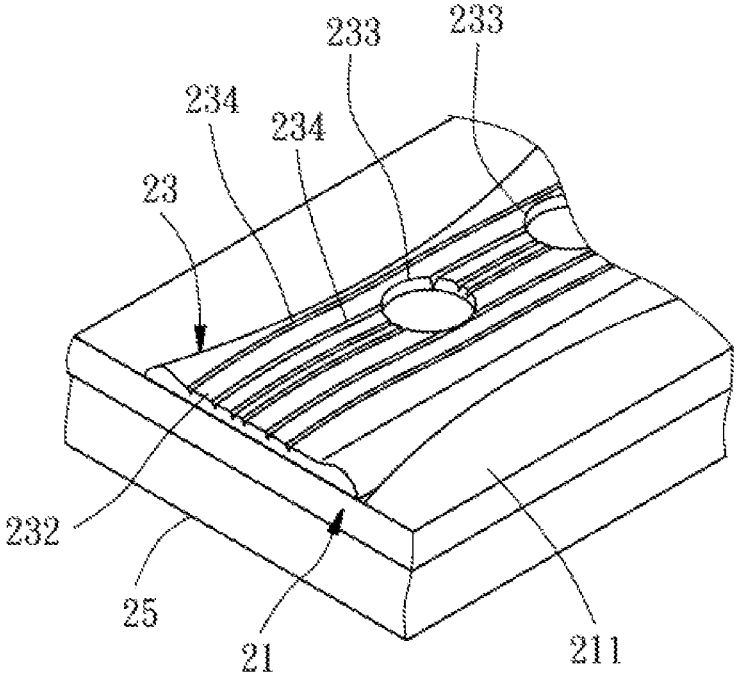
FIG. 6 is a sectional elevational view of the exercise mat in accordance with the second embodiment of the present invention, illustrating the cross-section of the anti-slip strip.

Referring to FIGS. 5 and 6, an exercise mat 20 with a continuous one-piece anti-slip strip in accordance with a second embodiment of the present invention is shown. This second embodiment is substantially similar to the aforesaid first embodiment with the exceptions as follows.

The elastic cushion layer 25 has a plurality of through hole 253 so that the second surface 212 of the fabric layer 21 is partially exposed to the outside through the through holes 253, facilitating drainage and ventilation.

The anti-slip strip 23 comprises a plurality of grooves 234 in the surface of the relatively lower middle portion 232 thereof so that the relatively lower middle portion 232 exhibits an uneven cross section. The anti-slip strip 23 further comprises a plurality of through holes 233 cut through the relatively lower middle portion 232 so that a part of the first surface 211 of the fabric layer 21 is exposed to the outside through the through holes 233. Further, the anti-slip strip 23 has an inconstant width portion. Further, the anti-slip strip 23 has contained therein a thermochromic color-changing substance (not shown). This thermochromic color-changing substance is an existing substance known in the art. Since showing the thermochromic color-changing substance of the anti-slip strip 23 in the drawings is difficult, the drawings do not indicate the thermochromic color-changing substance. Thus, when the user's body touches the anti-slip strip 23, the body temperature will cause the anti-slip strip 23 to change its color, adding visual interest. It is appreciated that the anti-slip strip 23 can also contain other substances, such as fluorescent substance for providing a fluorescent lighting effect, or spices for providing a pleasant smell, or antibacterial deodorant materials, such as metal/ore/coconut shell charcoal/charcoal, etc., for prohibiting the exercise mat from releasing a bad smell or getting moldy smell. Further, sensor means (not shown) can be provided at the bottom side of the anti-slip strip 23 for detecting the user's exercise status. The sensor means can be electrically connected to an electronic device (not shown) for recording the user's exercise status, or generating sound and/or light according to the h user's exercise status.

In the first surface 211 of the fabric layer 21 beyond the local areas A, at least one exposed portion 27 and a part of the anti-slip strip 23 exist in a surface area approximately equal to the surface area of the palm of an adult. Thus, no matter the user touches any surface area of the first surface 211 of the fabric layer 21, the exercise mat 20 provides anti-slip effects to the user regardless of whether the user's skin has sweat (nonslip in wet and dry environmental conditions).

Thus, in this second embodiment, the arrangement of the grooves 234 and through holes 233 in the anti-slip strip 23 significantly improves drainage and increases the surface area of the anti-slip strip 23, enhancing the anti-slip performance of the exercise mat. The characteristic of inconstant width of the anti-slip strip 23 makes the overall pattern full of change.

The other structural details and the effects of this second embodiment are same as the aforesaid first embodiment, and thus, no further detailed description in this regard will be necessary.

Figure 7:
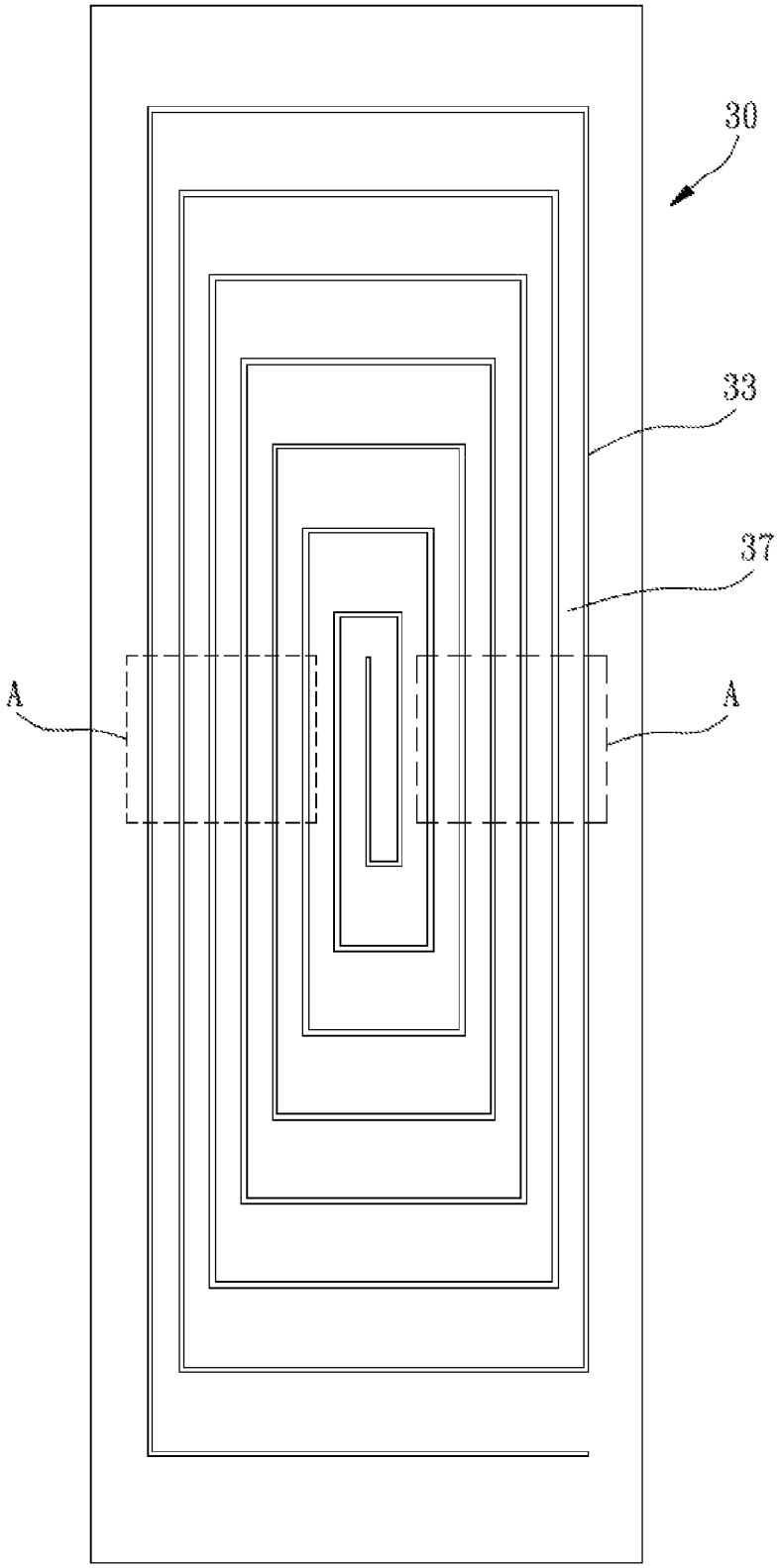
FIG. 7 is a top view of an exercise mat in accordance with a third embodiment of the present invention.
Figure 8:
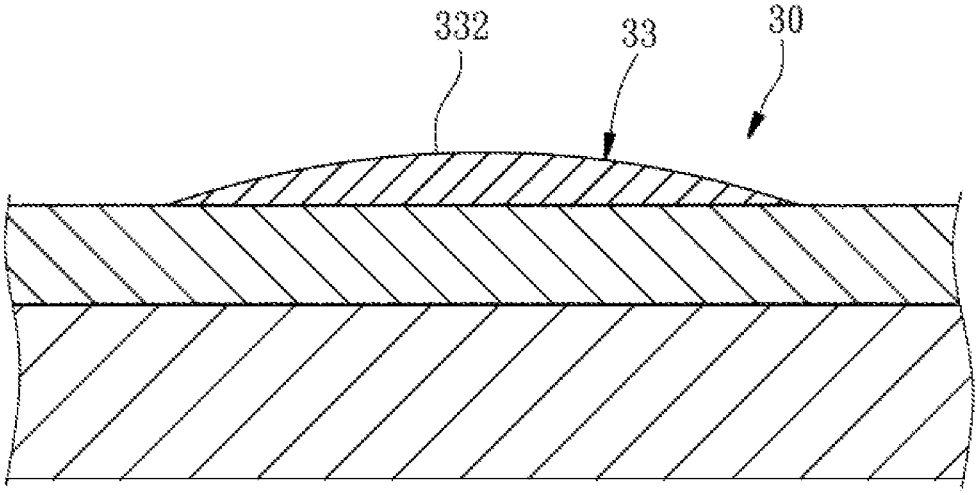
FIG. 8 is a sectional view of a part of the third embodiment of the present invention, illustrating the cross-section of the anti-slip strip.

Referring to FIGS. 7 and 8, an exercise mat 30 with a continuous one-piece anti-slip strip in accordance with a third embodiment of the present invention is shown. This third embodiment is substantially similar to the aforesaid first embodiment with the exceptions as follows.

The anti-slip strip 33 of this third embodiment has the two opposite lateral portions thereof relatively lower, and the middle portion 332 thereof relatively higher. Further, the anti-slip strip 33 is made in the form of a single line without intersections.

Thus, this third embodiment has only one single exposed portion 37. The design of the relatively lower lateral portions and relatively higher middle portion 332 of the anti-slip strip 33 can also increase the surface area of the anti-slip strip 23 and provide a three-dimensional structure to enhance the anti-slip performance.

The other structural details and the effects of this third embodiment are same as the aforesaid first embodiment, and thus, no further detailed description in this regard will be necessary.

What is claimed is:

1. An exercise mat, comprising:

a fabric layer defining a first surface and an opposing second surface;

only one single anti-slip strip of a predetermined width and in a predetermined pattern, said anti-slip strip being bonded to and covered over a part of said first surface of said fabric layer so that said first surface of said fabric layer defines at least one exposed portion beyond said anti-slip strip; and an elastic cushion layer bonded to and covered over said second surface of said fabric layer;

wherein said anti-slip strip is a continuous one-piece member defining two opposite lateral portions and a middle portion between said two opposite lateral portions, said two opposite lateral portions and said middle portion being disposed at different elevations;

said fabric layer defines a plurality of local areas in said first surface;

at least one said exposed portion and a part of said anti-slip strip exist in each said local area within a surface area approximately equal to the surface area of the palm of an adult.

2. The exercise mat as claimed in claim 1, wherein said elastic cushion layer is selected from the group of thermosetting plastics and thermoplastics.

3. The exercise mat as claimed in claim 2, wherein said thermosetting plastic material is selected from the group of polyurethane, epoxy resins, unsaturated polyesters and bakelite.

4. The exercise mat as claimed in claim 2, wherein said thermoplastic material is a composite material prepared by mixing a soft-segment plastic material with a hard-segment plastic material, said soft-segment plastic material being selected from the group of natural rubber, ethylene-propylene rubber, butyl rubber, polybutadiene, polyisoprene, polyisobutylene and polyethylene-butene; said hard-segment plastic material is selected from the group of polyethylene, polystyrene, polypropylene, polyurethane, polyester and polyamide.

5. The exercise mat as claimed in claim 1, wherein said elastic cushion layer comprises a plurality of through holes that expose a part of said second surface of said fabric layer to the outside.

6. The exercise mat as claimed in claim 1, wherein said middle portion of said anti-slip strip has an uneven cross section.

7. The exercise mat as claimed in claim 1, wherein said anti-slip strip further comprises a plurality of grooves located in said middle portion.

8. The exercise mat as claimed in claim 1, wherein the thickness of said middle portion of said anti-slip strip is equal to or less than 1 mm.

9. The exercise mat as claimed in claim 1, wherein in said first surface of said fabric layer beyond said local areas, at least one said exposed portion and a part of said anti-slip strip exist in a surface area approximately equal to the surface area of the palm of an adult.

10. The exercise mat as claimed in claim 1, wherein the main component of said anti-slip strip is silicone.

11. The exercise mat as claimed in claim 1, wherein said anti-slip strip is made in the form of a single line without intersections.

12. The exercise mat as claimed in claim 1, wherein said anti-slip strip is self-intersected, providing a plurality of intersections.

13. The exercise mat as claimed in claim 1, wherein said anti-slip strip has a consistent width in all parts thereof.

14. The exercise mat as claimed in claim 1, wherein said anti-slip strip has an inconsistent width portion.

15. The exercise mat as claimed in claim 1, wherein said anti-slip strip comprises a plurality of through holes cut through said middle portion to expose a part of said first surface of said fabric layer to the outside.

16. The exercise mat as claimed in claim 1, wherein said anti-slip strip contains a thermochromic color-changing substance that changes the color subject to a change in temperature.

* * * * *